US007967658B2

(12) United States Patent
Simpson

(10) Patent No.: US 7,967,658 B2
(45) Date of Patent: Jun. 28, 2011

(54) BRASSIERE HAVING DOUBLE LAYER SIDE PANELS

(75) Inventor: Elisabeth Simpson, Hong Kong (CN)

(73) Assignee: Triumph Intertrade AG, Bad Zurzach (CH)

( * ) Notice: Subject to any disclaimer, the term of this patent is extended or adjusted under 35 U.S.C. 154(b) by 452 days.

(21) Appl. No.: 12/116,226

(22) Filed: May 7, 2008

(65) Prior Publication Data

US 2008/0280533 A1 Nov. 13, 2008

(30) Foreign Application Priority Data

May 7, 2007 (DE) ..... 20 2007 006 693 U

(51) Int. Cl.
*A41C 3/00* (2006.01)

(52) U.S. Cl. ..... 450/39; 450/92

(58) Field of Classification Search ..... 450/39, 450/20, 21, 74–76, 60, 92, 93, 1, 3, 4, 7, 450/8

See application file for complete search history.

(56) References Cited

U.S. PATENT DOCUMENTS

| | | | | |
|---|---|---|---|---|
| 5,660,577 | A * | 8/1997 | Modena | 450/86 |
| 5,916,829 | A * | 6/1999 | Girard et al. | 442/244 |
| 6,000,994 | A * | 12/1999 | Salotto | 450/92 |
| 6,180,178 | B1 * | 1/2001 | Vogt | 427/389.9 |
| 6,238,266 | B1 * | 5/2001 | Vogt | 450/19 |
| 6,287,168 | B1 * | 9/2001 | Rabinowicz | 450/75 |
| 6,645,040 | B2 * | 11/2003 | Rabinowicz et al. | 450/1 |
| 6,837,771 | B2 * | 1/2005 | Falla | 450/39 |
| 7,192,332 | B2 * | 3/2007 | Liu | 450/39 |
| 7,407,427 | B2 * | 8/2008 | Liu | 450/39 |
| 7,563,152 | B2 * | 7/2009 | Liu | 450/39 |
| 7,682,219 | B2 * | 3/2010 | Falla | 450/92 |
| 2010/0144242 | A1 * | 6/2010 | Allen et al. | 450/39 |

* cited by examiner

*Primary Examiner* — Gloria Hale
(74) *Attorney, Agent, or Firm* — Muncy, Geissler, Olds & Lowe, PLLC

(57) ABSTRACT

A brassiere is provided with a front piece incorporating two breast cups and with two side pieces extending around the upper body of an individual wearing the brassiere, the first ends of which are fastened to the front piece at the sides and the second ends of which can be connected together in the back area of the individual. According to the invention, each of the side pieces includes two layers of a textile material, namely an outer layer facing away from the body and an inner layer facing the body, which are fastened together with an adhesive layer at the upper and lower edges of the respective side piece.

15 Claims, 3 Drawing Sheets

BRASSIERE HAVING DOUBLE LAYER SIDE PANELS

This nonprovisional application claims priority under 35 U.S.C. §119(a) to German Patent Application No. 20 2007 006 693.7, which was filed in Germany on May 7, 2007, and which is herein incorporated by reference.

BACKGROUND OF THE INVENTION

1. Field of the Invention

The invention relates to a brassiere.

2. Description of the Background Art

Brassieres of this class are commonly known, and are available in a multitude of variations all over the world. They are constructed of a front section, which essentially comprises two bra cups, which come in a wide variety of different shapes, and which are interconnected by a center part. Connected to the respective outer lateral edges of the front section is a side panel, the free ends of which can be joined at the back of the person wearing the brassiere by a back closure. The side panels can be sewn to the front section, or they can form a one-piece unit with the front section. Because the essential function of such brassieres is to bear the weight of and to support the bust, but also giving it contour, they are typically provided with shoulder straps in the form of support tapes, which connect the bra cups with the rearward side panels. Naturally, aside from high wearing comfort, such brassieres are expected to provide an appealing look.

Apart from the fact that typically, brassieres of this kind are comprised of a plurality of parts, which are interconnected by seams, they most often have support bands, piping, or trimming ribbons along their edges, which are mostly attached with zigzag seams because the side panels in particular are frequently made of elastic materials. However, practical experience has shown that these seams often show through outer garments, which takes away from the overall look. Furthermore, these tapes fixed into place by seams come into direct contact with the skin of the person wearing the brassiere, which can lead to skin irritations, particularly with people having sensitive skin, thus reducing the wearing comfort considerably. This is particularly true for the seams in the area of the side panels because a good fit of the brassiere requires proper tension of the side panels, whereby said panels are pressed against the upper body of the wearer.

Frequently, skin irritations are also caused by most often net-like inserts reinforcing the elastic force, which, because of the outer look of the brassiere, are arranged on the inner side of the side panels.

SUMMARY OF THE INVENTION

In view of this background, it is an object of the invention to improve a conventional brassiere with respect to its wearing comfort and its overall look.

The invention is based on the idea to design a brassiere having double-layered side panels such that the two layers are only interconnected in the peripheral areas at the upper and lower edge by internal level bonding agents, in particular an adhesive layer. Due to the fact that both external surfaces of the side panels, that is, the visible exterior side as well as the inner side facing the body, are comprised of textile material bare of any seams, the brassiere of the present invention not only attains a most appealing outer look, but in addition, direct contact between any seams and the skin is precluded on the inner side. In this way, the wearing comfort is improved significantly, and even with sensitive skin, and the threat of skin irritations of any kind is eliminated. This is particularly true if a reinforcing insert made of an elastic net-like material, for example, is arranged between these two layers of material in order to improve the shaping properties of the brassiere. Furthermore, the invention allows the support tapes of the shoulder straps to be included in its conceptual design. This is done in a simple way such that the respective support tapes are inserted in a corresponding opening in the area of the upper edge of the side panels into the space between the two layers.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
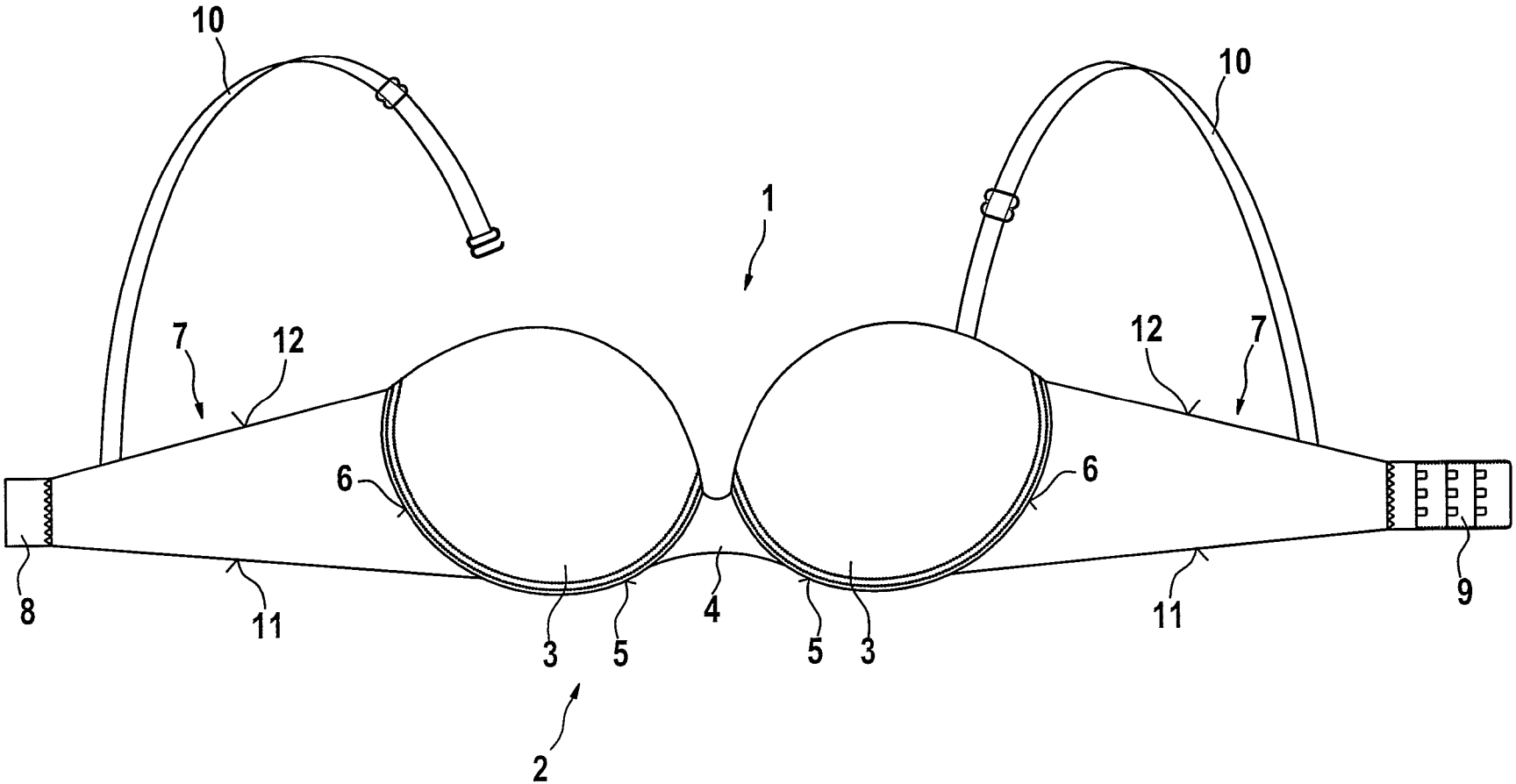
FIG. 1 is a front view of a brassiere according to the present invention.

In FIG. 1, a brassiere 1 according to the present invention is illustrated in a front view. The brassiere 1 is comprised of a front section 2 having two bra cups 3 to accommodate the bust. The bra cups 3 can be of conventional design, that is, for example, have a rubber foam core, which is covered with a textile material, both on the outside and the inside. The two bra cups 3 are interconnected by a center part 4, which in the instant embodiment has a roughly trapezoidal shape.

Along the lower edge of the bra cups 3, a small channel 5 is indicated, which can accommodate respective underwires if need be. The opposite upper edge of the bra cups 3 is unencumbered, and with its attachment pieces (not illustrated), provides attachment points for fastening the front ends of the two shoulder straps 10.

Attached to each of the lateral edges 6 of bra cups 3 is a side panel 7, whereby at its free end, the left side panel 7 as seen in the illustration is provided with a hook tape 8, whereas the opposite side panel 7 is provided with an eyelet tape 9. Together, hook tape 8 and eyelet tape 9 provide, in well-known fashion, a back closure. Furthermore, the side panels 7 are defined by a lower edge 11 and an upper edge 12.

Figure 5:
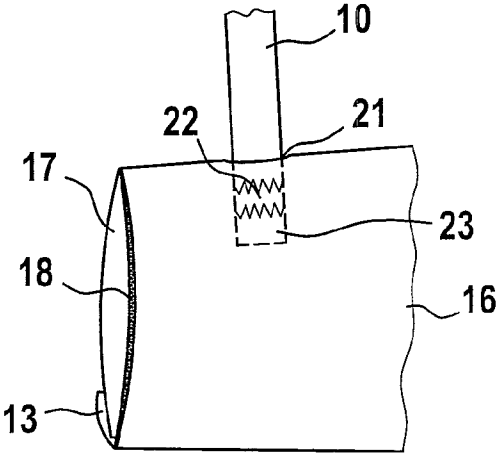
FIG. 5 shows, in a detail drawing, a perspective view of the side panel in the area of the attachment of a support tape.
Figure 2:
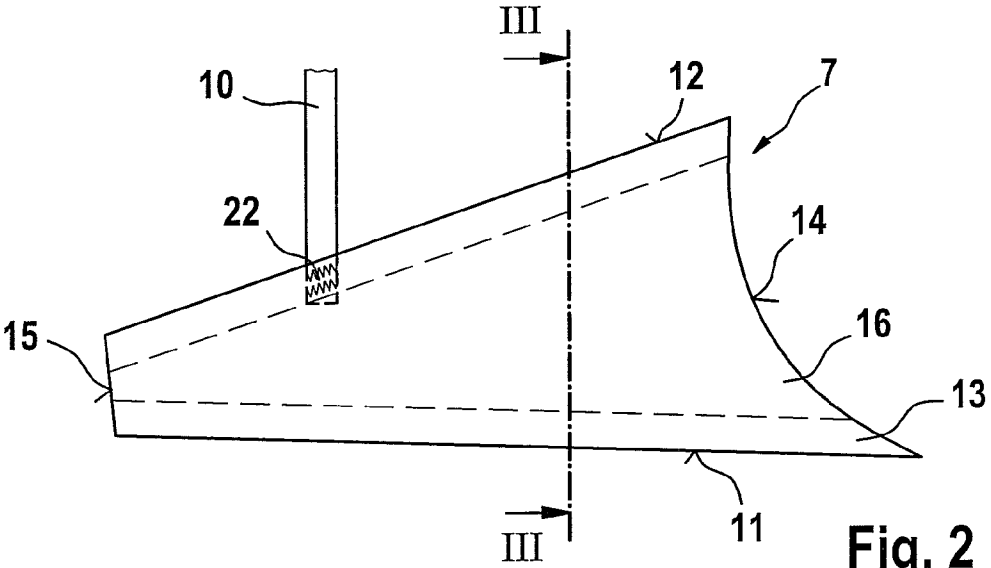
FIG. 2 is a schematic drawing of the exterior view of a side panel of a first embodiment of the invention.

The more detailed design of the side panels 7 is illustrated in the figures, wherein FIGS. 2 and 5 on the one hand, and FIGS. 6 to 9 on the other hand, show various embodiments for attaching the shoulder straps to the side panels.

Figure 3:
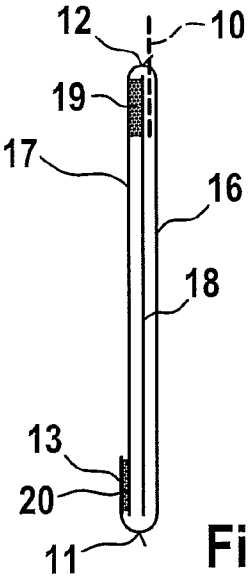
FIG. 3 is a sectional view along the line III-III in FIG. 2.
Figure 4:
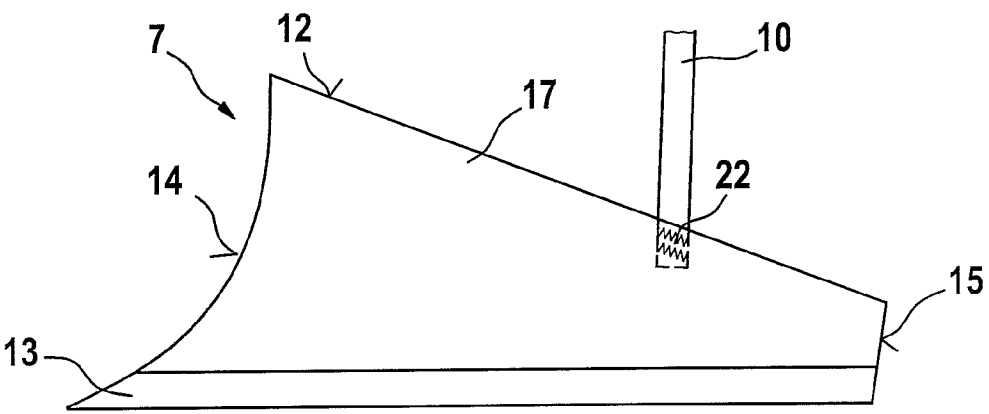
FIG. 4 is a schematic drawing of the inside view of the side panel of FIG. 2.
Figure 7:
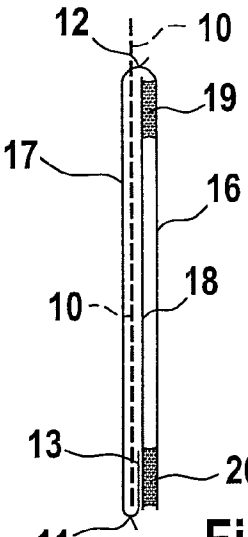
FIG. 7 is a sectional view along the line VII-VII in FIG. 6.
Figure 9:
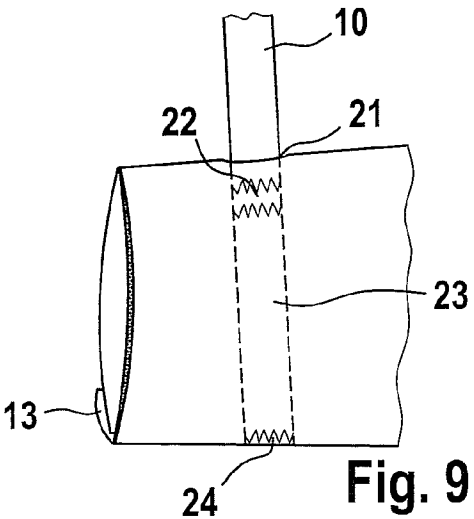
FIG. 9 shows, in a detail drawing, a perspective view of the side panel in the area of the attachment of a support tape.
Figure 6:
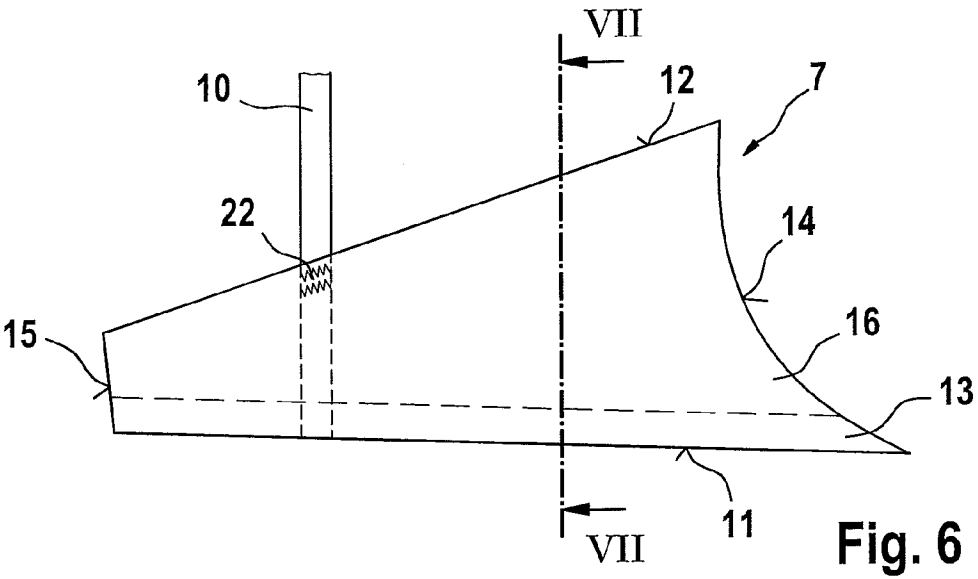
FIG. 6 is a schematic drawing of the exterior view of a side panel of a second embodiment of the invention.
Figure 8:
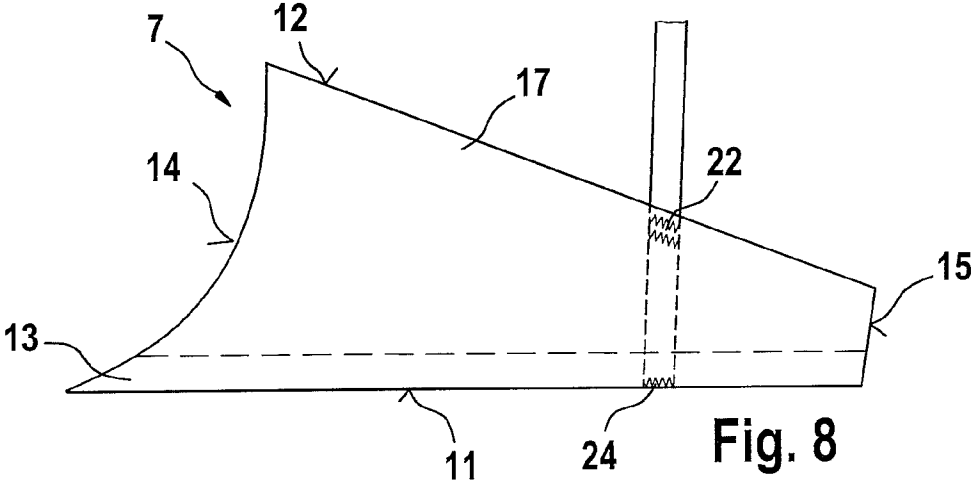
FIG. 8 is a schematic drawing of an inside view of the side panel in FIG. 6.

FIG. 2 shows, in schematic illustration, the external view of a side panel 7 of a brassiere of the present invention, whereas FIG. 4 illustrates the corresponding internal view. It can be seen in the section along line III-III according to FIG. 2 in particular, which is shown in FIG. 3, how the entire side panel 7 is one single blank cut of a textile material, whereby the upper edge 12 of side panel 7 is formed by a single foldover, whereas the lower edge 11 is formed by folding to create a turned edge 13. With regard to the lateral edges, the front edge 14 is designed to be attached to the lateral edge 6 of a bra cup 3; the rearward edge 15 of one side panel is used to attach a hook tape 8, and its counterpart is used to attach an eyelet tape 9.

It becomes particularly apparent from the cross section of the side panel 7 according to FIG. 3 that between the outer layer 16 and the inner layer 17 of the textile material forming the side panel 7, a reinforcing insert 18 is provided. Beneficially, this reinforcing insert 18 is of a net-like structure of an elastic material.

The assembly of the individual parts to form a side panel 7 is beneficially done by using an adhesive tape 19, which fixes the reinforcing insert 18 into place at the upper edge 12 of the inner layer 17 of side panel 7, as well as an additional adhesive tape 20, which fixes the turned-over edge 13 into place at the lower edge 11 against the inner layer 17 of side panel 7. The reinforcing insert 18 can be unattached in the area of the lower edge 11.

It is also indicated in FIGS. 2 to 5 how the support tape of shoulder strap 10 is attached at the upper edge 12 of side panel 7. The shoulder strap 10 is hereby inserted through an opening 21 (FIG. 5) into the space between the outer layer 16 and the inner layer 17, where it is fastened with suitable bonding agents, for example, an adhesive or welded joint 22. The inner end 23 of shoulder strap 10 ends just below the fastening joint 22.

The embodiment illustrated in FIGS. 6 to 9 is distinct from the embodiment according to FIGS. 2 to 5 such that the lower turned-over edge 13 of the outer layer 16 of the material forming the side panel 7 is turned to the inside, and is thus covered by the material of the inner layer 17. This is essentially illustrated in FIG. 7. It can also be seen in FIG. 7 how the reinforcing insert 8 [sic.], which is likewise attached to the inner textile layer 17 of the material in the area of the upper edge 12 by an adhesive tape 19, extends to the area of the lower edge 11 into the space between the turned-over edge 13 and the inner textile layer 17, where it is fixed into place by an adhesive tape 20, which connects the turned-over edge 13 with the inner surface of the inner textile layer 17.

It is also illustrated in FIGS. 6 to 9 how the shoulder strap 10 is guided between the two layers 16 and 17 of side panel 7, from its entry at the upper edge 12 to the lower edge 11. In this embodiment, the shoulder strap 10 is fixed into place not only in the area of the upper edge 12 at a fastening point 22, but also in the area of the lower edge 11 at a fastening point 24.

The adhesive tape 19 and/or 20 used to fix the pieces into place is, for practical purposes, provided with a thermo-sensitive adhesive. The adhesive tape 19 and/or 20 can then be simply be positioned between the pieces to be connected, and by applying pressure and/or heat, an intensive bonding of the parts can be achieved. Naturally, instead of using an adhesive tape, it is also possible to coat the surfaces to be joined with a suitable bonding agent, which likewise can be activated by applying pressure and/or heat. Bonding agents, which fill these requirements, are known.

The invention is not limited to the embodiment illustrated in the drawings but also includes embodiments, which correspond with the object and purpose of the patent claims. For example, the term "brassiere" comprises all women's intimate apparel with built-in bust support, including bikini tops, swimsuits, and bodysuits, and the like.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A brassiere comprising:

a front section, which includes two bra cups; and two side panels configured to encircle an upper body of a person wearing the brassiere, first ends of each of the two side panels laterally attached to the front section, and second ends of each of said side panels configured to be joined together at a back of the person, wherein the respective side panels are comprised of two layers of a textile material, the two layers including an outer textile layer facing away from the body and an inner textile layer facing the body, which layers are interconnected along only peripheral areas along upper and lower edges of the side panels by an adhesive layer.

2. The brassiere according to claim 1, wherein the side panels are comprised of a material blank, and that the two layers of texile are formed by folding over said material blank such that the edge created by said folding over of said material blank forms the upper edge of the side panels, and wherein the opposite free ends of the material blank forming free ends of said outer and inner layers are adhesively joined together forming the lower edge of the side panels.

3. The brassiere according to claim 1, wherein between the two layers of the side panels, a reinforcing insert is arranged, which is connected to the side panels, at least in the area of an upper edge thereof.

4. The brassiere according to claim 3, wherein the reinforcing insert is made of a netlike elastic material.

5. The brassiere according to claim 2, wherein at the lower edge, the outer layer of the material of the side panels is folded over around the free end of the inner layer, and is connected thereto in the area of the edge formed by said folding over of said outer layer.

6. The brassiere according to claim 1, wherein the outer layer of the material of the side panels is folded to the inside at the lower edge, and in the area of the edge formed by said folding over of said outer layer, is connected to the inner surface of the material of the inner layer.

7. The brassiere according to claim 6, wherein a reinforcing insert is arranged between the edge formed by said folding over of said outer layer and the inner surface of the material of the inner layer, and is connected therewith.

8. The brassiere according to claim 1, wherein the brassiere has two shoulder straps in the form of support tapes, which extend from the bra cups to a rearward area of the side panels at the back of said wearer, and wherein the support tapes of the shoulder straps are inserted between the two layers of the respective side panels, and are attached thereto.

9. The brassiere according to claim 8, wherein the respective support tapes of the shoulder straps are inserted at the upper edge of the respective side panels through an opening between the two layers of the side panels, and are attached thereto.

10. The brassiere according to claim 9, wherein the support tapes of the shoulder straps are inserted between the two layers of the respective side panels to reach all the way to the lower edge thereof, and are connected to the side panels both in the area of the upper edge and in the area of the lower edge thereof.

11. The brassiere according to claim 1, wherein the adhesive layer is made of a thermo-sensitive material, which can be activated by applying pressure and/or heat.

12. The brassiere according to claim 11, wherein the adhesive layer is applied directly to the peripheral areas of the material blanks forming the side panels by a spraying, rolling, or pressure process.

13. The brassiere according to claim 11, wherein the adhesive layer is applied to an adhesive tape, which is put between the pieces of the textile material to be connected in order to interconnect the parts.

14. The brassiere according to claim 13, wherein the adhesive tape has elastic properties.

15. The brassiere according to claim 8, wherein the adhesive layer is made of a polyurethane, a polyolephin, or a thermoplastic elastomer.

* * * * *